US006997702B1

(12) United States Patent
Chen

(10) Patent No.: US 6,997,702 B1
(45) Date of Patent: Feb. 14, 2006

(54) LIGHTER

(75) Inventor: Jan-Nan Chen, Taichung (TW)

(73) Assignee: Arlo Lin, Tortola (VG)

( * ) Notice: Subject to any disclaimer, the term of this patent is extended or adjusted under 35 U.S.C. 154(b) by 0 days.

(21) Appl. No.: 10/970,256

(22) Filed: Oct. 21, 2004

(51) Int. Cl.
*F23Q 7/12* (2006.01)

(52) U.S. Cl. ..... 431/344; 431/153; 431/255; 431/345; 222/530

(58) Field of Classification Search ..... 431/153, 431/345, 344; 362/198; D7/416; D9/447; 220/708, 710; 215/229; 222/530
See application file for complete search history.

(56) References Cited

U.S. PATENT DOCUMENTS

| | | | | | |
|---|---|---|---|---|---|
| 1,907,763 | A | * | 5/1933 | England | 222/204 |
| 2,262,628 | A | * | 11/1941 | Wilson | 222/189.06 |
| 2,744,661 | A | * | 5/1956 | Davis | 222/189.06 |
| 2,770,399 | A | * | 11/1956 | Gross | 222/211 |
| 2,789,734 | A | * | 4/1957 | Biederman | 222/207 |
| 3,160,330 | A | * | 12/1964 | Pollitt | 222/209 |
| 3,184,123 | A | * | 5/1965 | Willshaw | 222/321.9 |
| 3,674,413 | A | * | 7/1972 | Fraser | 431/344 |
| 3,863,817 | A | * | 2/1975 | Speaker | 222/530 |
| D241,645 | S | * | 9/1976 | Lanzi | D7/416 |
| 4,165,814 | A | * | 8/1979 | Seel | 215/229 |
| 4,318,403 | A | * | 3/1982 | Sneider | 604/2 |
| 4,538,983 | A | * | 9/1985 | Zeller et al. | 431/255 |
| 4,568,345 | A | * | 2/1986 | Keilman et al. | 604/403 |
| D291,004 | S | * | 7/1987 | Keilman et al. | D24/117 |
| 4,684,032 | A | * | 8/1987 | Tsay | 215/389 |
| D294,329 | S | * | 2/1988 | Matsumaru | D7/416 |
| 4,726,479 | A | * | 2/1988 | Tsai | 215/229 |
| 4,738,242 | A | * | 4/1988 | Hart | 126/271.1 |
| 5,154,483 | A | * | 10/1992 | Zeller | 362/198 |
| 5,199,865 | A | * | 4/1993 | Liang | 431/255 |
| 5,273,172 | A | * | 12/1993 | Rossbach et al. | 215/229 |
| 5,369,556 | A | * | 11/1994 | Zeller | 431/344 |
| 5,518,143 | A | * | 5/1996 | Iodice | 220/708 |
| D382,441 | S | * | 8/1997 | Ferrara, Jr. | D7/416 |
| 5,738,507 | A | * | 4/1998 | Mifune et al. | 431/344 |
| D405,644 | S | * | 2/1999 | Hsu | D7/416 |
| D454,277 | S | * | 3/2002 | Chevalier | D7/416 |
| D462,235 | S | * | 9/2002 | Chevalier et al. | D7/416 |
| 6,488,492 | B1 | | 12/2002 | Adams et al. | 431/153 |
| 6,648,630 | B1 | * | 11/2003 | Tse | 431/153 |
| 6,708,849 | B1 | * | 3/2004 | Carter et al. | 222/153.1 |
| 2002/0094500 | A1 | * | 7/2002 | Tse | 431/153 |

* cited by examiner

*Primary Examiner*—Carl D. Price
(74) *Attorney, Agent, or Firm*—Alan D. Kamrath; Nikolai & Mersereau, P.A.

(57) ABSTRACT

A lighter includes a body for containing fuel, a tube extending from the body for transmitting the fuel and a nozzle attached to the tube for spraying the fuel. In an idle mode, the tube can be wound around the body. In a working mode, the tube is unwound from the body.

12 Claims, 7 Drawing Sheets

LIGHTER

BACKGROUND OF INVENTION

1. Field of Invention

The present invention relates to a lighter.

2. Related Prior Art

Referring to U.S. Pat. No. 6,488,492 that was issued on Dec. 3, 2002, a lighter 2 includes a body 4 and a pipe 101 pivotally connected with the body 4. The pipe 101 is made of a metal or a rigid material. The pipe 101 cannot be operated in limited and crooked space because the pipe 101 cannot be deformed in compliance with the limited and the crooked space. This causes the user inconvenience.

The present invention is therefore intended to obviate or at least alleviate the problems encountered in the prior art.

SUMMARY OF INVENTION

A lighter includes a body for containing fuel, a tube extending from the body for transmitting the fuel and a nozzle attached to the tube for spraying the fuel. In an idle mode, the tube can be wound around the body. In a working mode, the tube is unwound from the body.

The primary advantage of the present invention is to provide a lighter including a tube that can adapt to limited and crooked space.

Other objects, advantages, and novel features of the invention will become more apparent from the following detailed description when taken in conjunction with the drawings.

BRIEF DESCRIPTION OF DRAWINGS

The present invention will be described through detailed illustration of embodiments referring to the drawings.

DETAILED DESCRIPTION OF EMBODIMENTS

Figure 1:
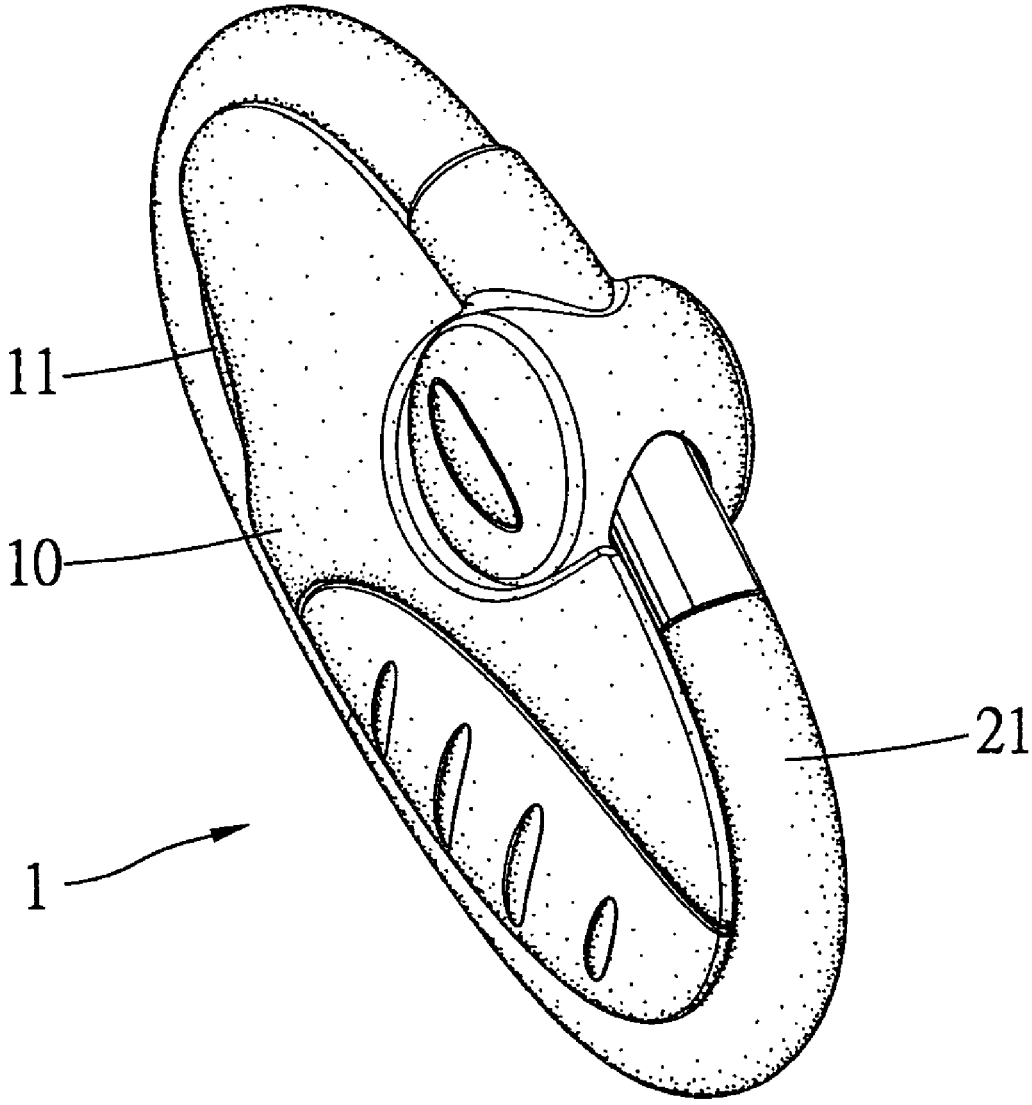
FIG. 1 is a perspective view of a lighter according to a first embodiment of the present invention.
Figure 2:
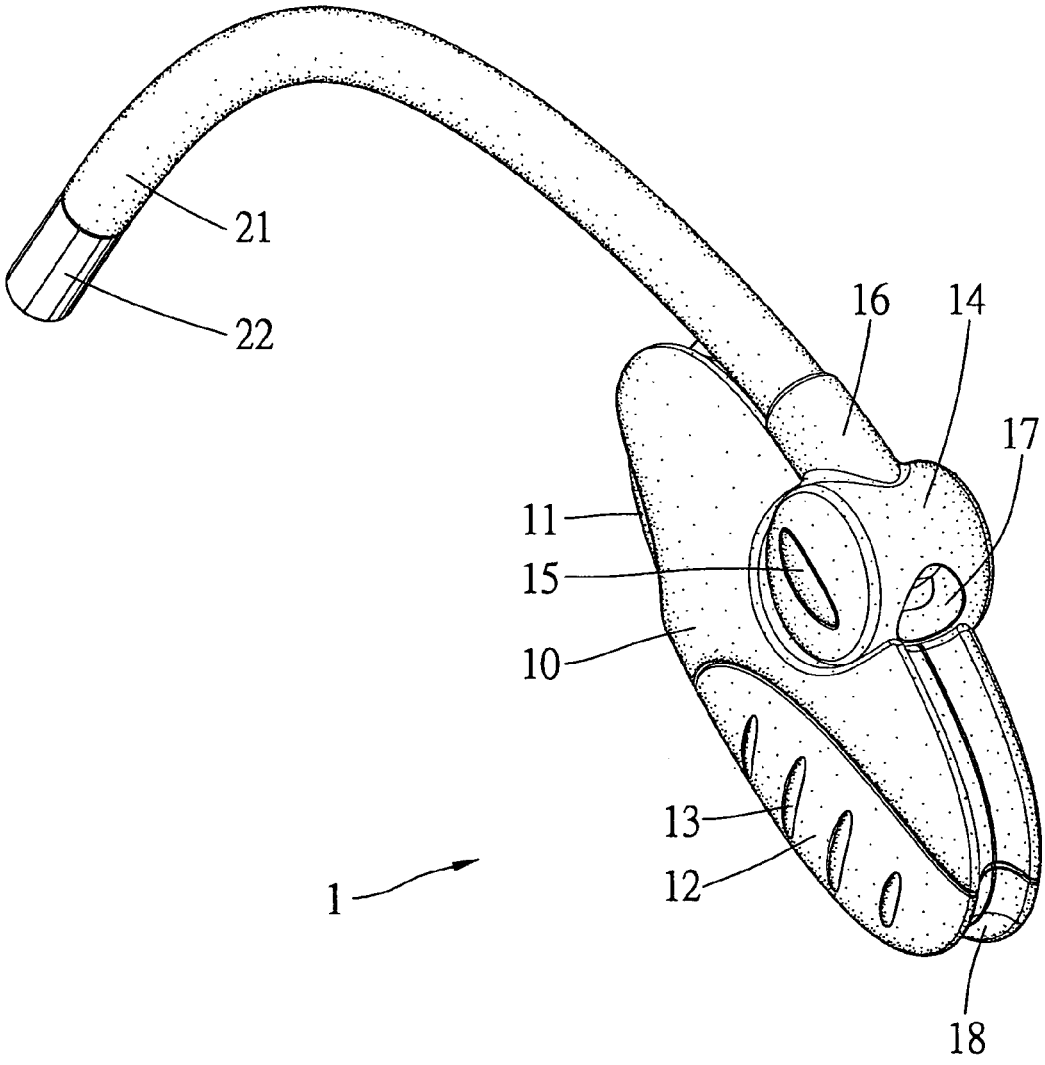
FIG. 2 is similar to FIG. 1 but shows a tube unwound from a body of the lighter.
Figure 3:
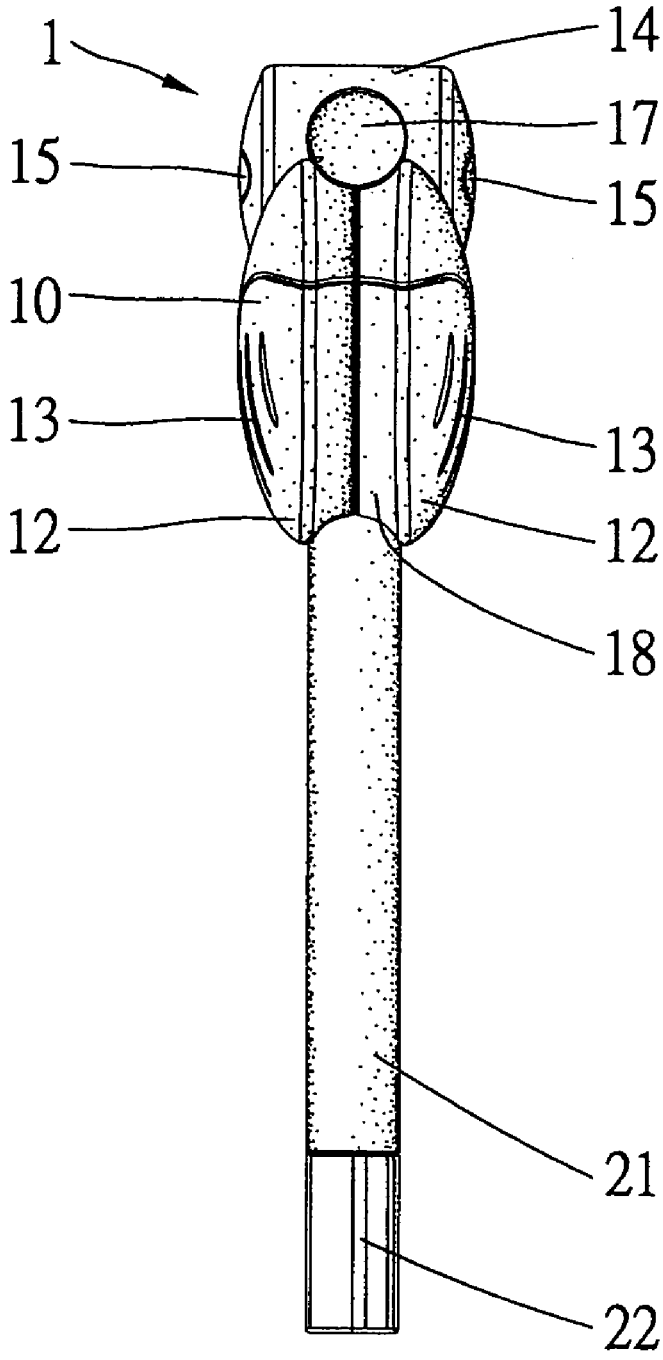
FIG. 3 is a rear view of the lighter shown in FIG. 2.
Figure 4:
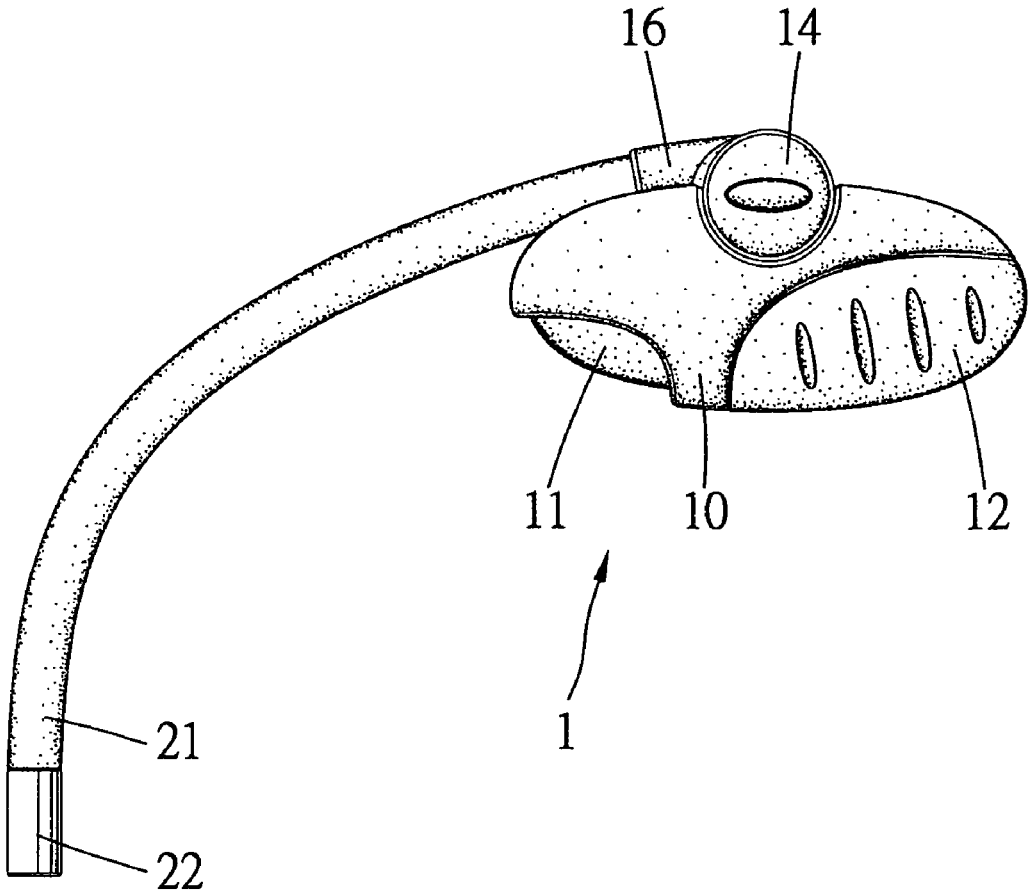
FIG. 4 is a side view of the lighter of FIG. 2.

FIGS. 1 to 4 show a lighter 1 according to a first embodiment of the present invention. The lighter 1 includes a body 10 and a tube 21.

The body 10 includes a grip 12 formed at an end thereof and a trigger 11 installed at an opposite end thereof. The body 10 includes a groove 18 defined in the periphery thereof. The body 10 is shaped like an oval. The grip 12 includes two sides each including a plurality of cavities 13 defined therein. A user can hold the lighter 1 stably because of the grip 12. Although not shown for being conventional, an ignition device is provided in the body 10.

A joint 14 is provided between the body 10 and the tube 21. The joint 14 includes a socket 16 formed at an end thereof and a recess 17 defined in an opposite end thereof. The joint 14 includes two sides each defining a cavity 15 for aesthetic purposes. The joint 14 is shaped like a drum.

The tube 21 includes an end connected with the socket 16 and an opposite end connected with a nozzle 22. The tube 21 is made of a soft material. The tube 21 can be wound around the body 10 by means of the groove 18 and inserted into the recess 17 with the nozzle 22. The nozzle 22 is made of metal.

Figure 5:
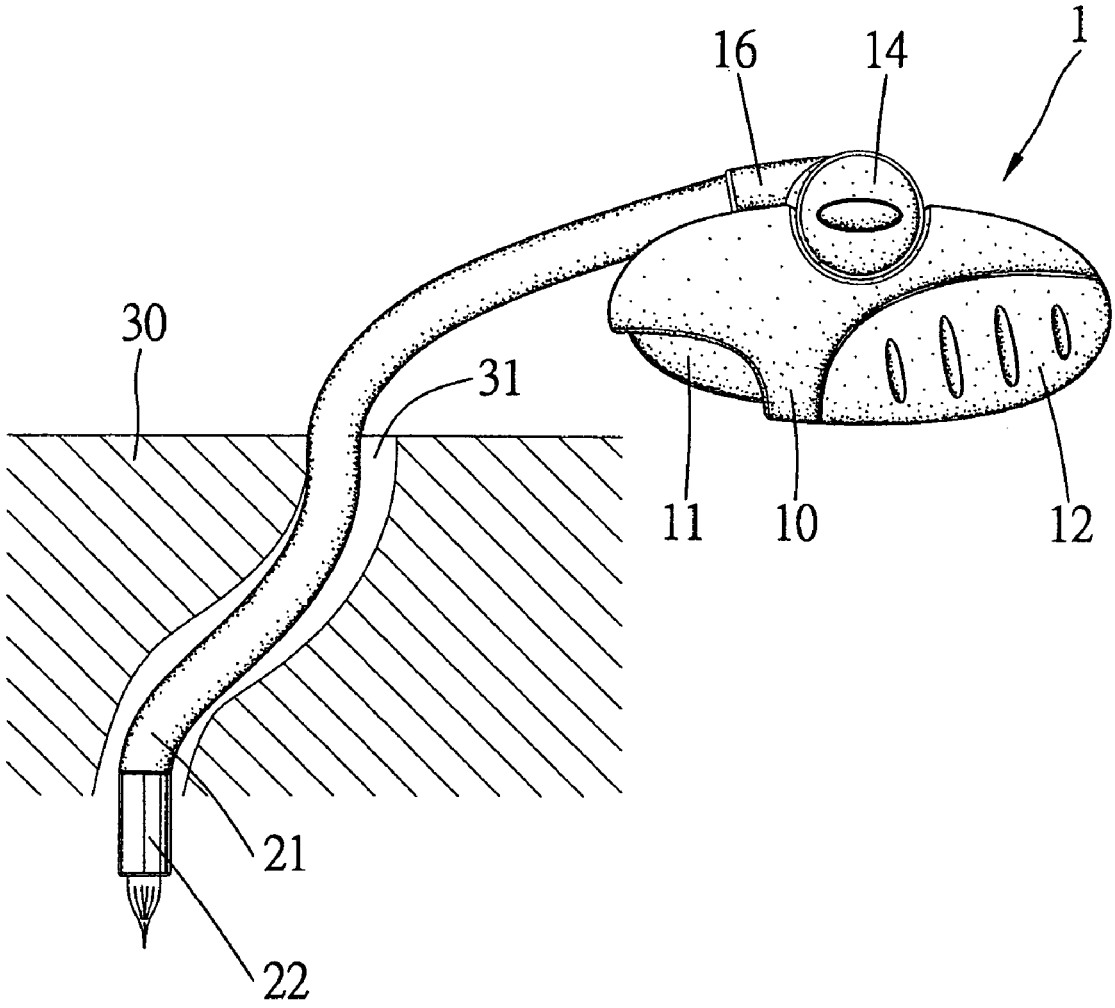
FIG. 5 is similar to FIG. 4 but shows the lighter in a working mode.

FIG. 5 shows the lighter 1 in a working mode. The tube 21 is unwound from the body 10 and inserted into a passage 31 of a working object 30. The tube 21 can be operated in limited and crooked passage 31 because the tube 21 can be deformed in compliance with the limited and crooked passage 31. Thus, the tube 21 is not blocked to get to a lighting position. Moreover, a user can press the trigger 11 to drive an ignition device so as to spray a flame from the nozzle 22.

Figure 6:
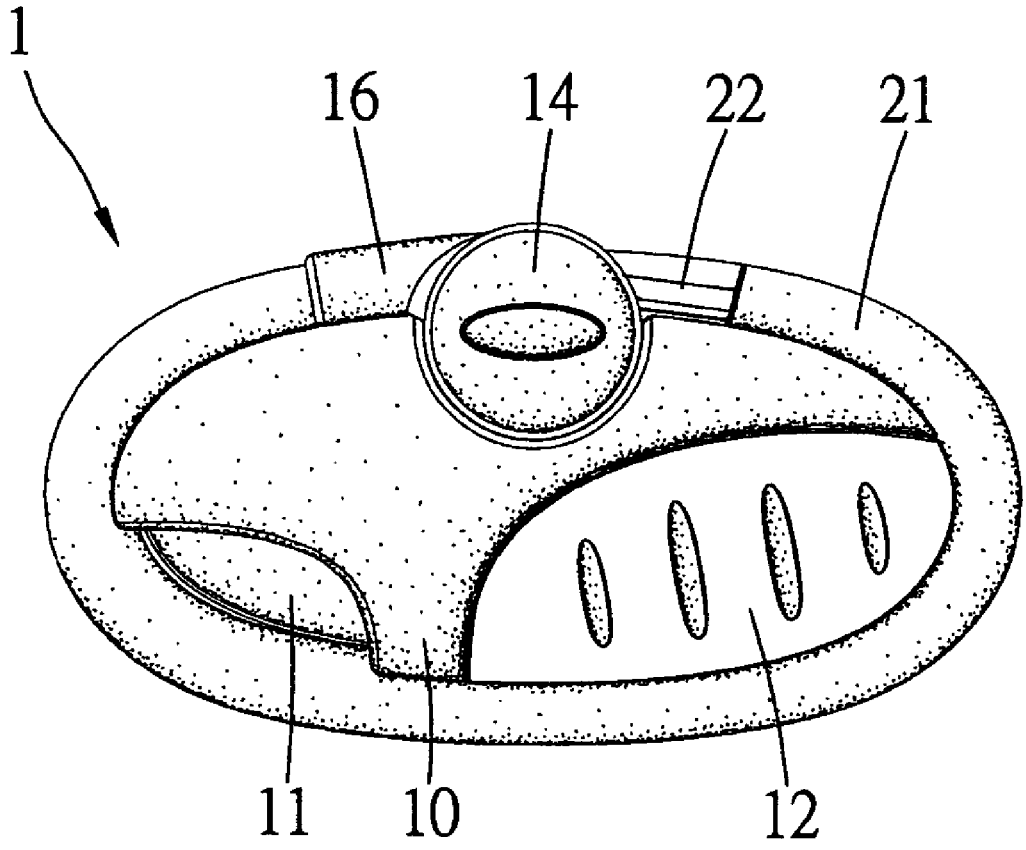
FIG. 6 is a side view of the lighter shown in FIG. 1.

Referring to FIG. 6, the tube 21 is wound around the body 10 and directed over the trigger 11. Thus, the trigger 11 will not be collided by an extra object so that the risk of accidental ignition can be avoided.

Figure 7:
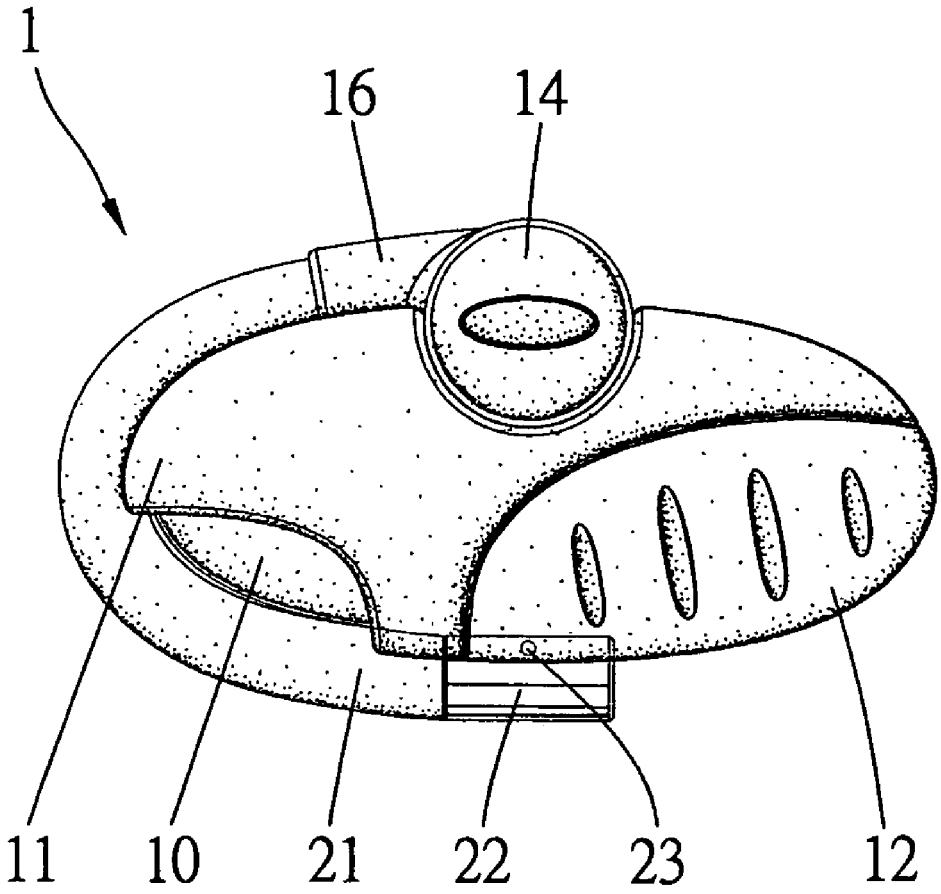
FIG. 7 is a side view of a lighter according to a second embodiment of the present invention.

FIG. 7 shows a lighter 1 according to a second embodiment of the present invention. The second embodiment is identical to the first embodiment except for several things. Firstly, the joint 14 is pivotally connected with the body 10. Secondly, the tube 21 can be wound substantially halfway around the body 10. Thirdly, the nozzle 22 includes a boss 23 formed thereon for insertion in a recess defined in the wall of groove 18.

The present invention has been described through detailed illustration of the embodiments. Those skilled in the art can derive variations from the embodiments. The embodiments hence shall not limit the scope of the present invention defined in the claims.

What is claimed is:

1. A lighter comprising, in combination: a body, with the body having a periphery; a flexible tube having a first end connected to the body and having an opposite end; a nozzle fixed to the opposite end of the flexible tube; a trigger installed on the body, with the body including a groove defined in the periphery for receiving the flexible tube and located on opposite sides of the trigger, with the groove defined by a wall, with the trigger having an outer surface contiguous with an inner most portion of the wall of the groove, wherein the flexible tube can be wound around the body in the groove and extending over, engaging and concealing the outer surface of the trigger; and a joint provided between the body and the flexible tube, wherein the joint comprises a socket for receiving the first end of the flexible tube, wherein the joint defines a recess for receiving the opposite end of the flexible tube, wherein the joint is shaped like a drum having a cylindrical periphery and first and second sides, with the socket formed in an end of the cylindrical periphery, with the recess formed in an opposite end of the cylindrical periphery.

2. The lighter according to claim 1 wherein the joint is pivotally connected with the body about an axis of the cylindrical periphery.

3. The lighter according to claim 1 wherein the groove and the outer structure of the trigger are shaped like an oval.

4. The lighter according to claim 1 wherein the flexible tube can be wound substantially all the way around the body.

5. The lighter according to claim 4 wherein the flexible tube wound substantially all the way around the body is shaped like an oval.

6. A lighter comprising:

a body for containing fuel;

a flexible tube for transmitting the fuel and extending from the body;

a nozzle for spraying a flame and fixed to the flexible tube; and a joint provided between the body and the flexible tube, wherein the joint comprises a socket for receiving an end of the flexible tube, wherein the joint defines a recess for receiving an opposite end of the flexible tube wherein the joint is shaped like a drum having a cylindrical periphery and first and second sides, with the socket formed in an end of the cylindrical periphery, with the recess formed in an opposite end of the cylindrical periphery, wherein the joint is pivotally connected with the body about an axis of the cylindrical periphery, wherein the body includes a groove defined in a periphery thereof for receiving the tube, wherein the joint is pivotally connected within a channel formed in the periphery of the body, with the joint and the flexible tube received in the socket and the recess of the joint together shaped like an oval.

7. The lighter according to claim 6 wherein the body comprises a grip formed thereon so that a user can hold the lighter stably.

8. The lighter according to claim 7 wherein the grip comprises two sides each comprising a plurality of cavities defined therein.

9. The lighter according to claim 6 comprising a trigger installed on the body, wherein the flexible tube can be wound around the body in order to conceal the trigger.

10. The lighter according to claim 6 wherein the nozzle is made of metal.

11. A lighter comprising;

a body for containing fuel;

a flexible tube for transmitting the fuel and extending from the body;

a nozzle for spraying a flame and fixed to the flexible tube; and a joint provided between the body and the flexible tube, wherein the joint comprises a socket for receiving an end of the flexible tube, wherein the joint defines a recess for receiving an opposite end of the flexible tube, wherein the joint is shaped like a drum having a cylindrical periphery and first and second sides, with the socket formed in an end of the cylindrical periphery, with the recess formed in an opposite end of the cylindrical periphery, wherein the joint is pivotally connected with the body about an axis of the cylindrical periphery, wherein the body includes a groove defined in a periphery thereof for receiving the tube, wherein the groove extends all the way between the socket and the recess around the periphery of the body.

12. The lighter according to claim 11 wherein the body is shaped like an oval.

* * * * *